US006385414B1

(12) United States Patent
Sato et al.

(10) Patent No.: US 6,385,414 B1
(45) Date of Patent: May 7, 2002

(54) CONTAMINANT PREVENTING STRUCTURE FOR IMAGE FORMING APPARATUS AND PROCESS CARTRIDGE

(75) Inventors: Fumikazu Sato, Inuyama; Hideaki Deguchi; Naoya Kamimura, both of Nagoya; Mitsuru Horinoe, Aichi; Makoto Ishii, Nagoya; Tsuyoshi Suzuki, Owariasahi, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/641,757

(22) Filed: Aug. 21, 2000

(30) Foreign Application Priority Data

Aug. 23, 1999 (JP) ..... 11-235569
Sep. 29, 1999 (JP) ..... 11-276215

(51) Int. Cl.[7] ..... G03G 15/02; G03G 21/00

(52) U.S. Cl. ..... 399/98; 399/88; 399/99; 399/171

(58) Field of Search ..... 399/169, 98, 99, 399/102, 130, 105, 148, 171, 172, 170, 111

(56) References Cited

U.S. PATENT DOCUMENTS 4,943,829 A * 7/1990 Sasaki et al. ..... 399/105
4,984,018 A * 1/1991 Andou et al. ..... 399/111
5,436,700 A * 7/1995 Kikuchi et al. ..... 399/98 X
5,826,153 A * 10/1998 Hazama et al. ..... 399/111 X
5,953,559 A * 9/1999 Obu ..... 399/110

FOREIGN PATENT DOCUMENTS

| | | | |
|---|---|---|---|
| JP | 3-4284 | * | 1/1991 |
| JP | 4-348364 | * | 12/1992 |
| JP | 7-234625 | * | 9/1995 |
| JP | 8-30157 | * | 2/1996 |
| JP | 9-114187 | * | 5/1997 |
| JP | 10-116012 | * | 5/1998 |
| JP | 2000-227743 | * | 8/2000 |

* cited by examiner

*Primary Examiner*—Joan Pendegrass
(74) *Attorney, Agent, or Firm*—Oliff & Berridge PLC

(57) ABSTRACT

A device for preventing contamination of a print sheet and the reduction in the effectiveness of a scorotron type charger by free toner and paper particles. The device includes a paper dust eliminator extending the length of a photosensitive member and a wiping mechanism at each end of the photosensitive member for removing free toner that has accumulated there. Further, a partition that separates the developing section from the charger can be provided to further reduce free toner from attaching to the charger.

22 Claims, 11 Drawing Sheets

CONTAMINANT PREVENTING STRUCTURE FOR IMAGE FORMING APPARATUS AND PROCESS CARTRIDGE

BACKGROUND OF THE INVENTION

1. Field of Invention

The invention relates to an image forming apparatus that forms an image by transferring a developing agent onto a sheet by electrophotography.

2. Description of Related Art

In a well-known developing device, development is made by electrostatically adhering the toner held on the surface of the developing roller to an electrostatic latent image formed on the surface of the photosensitive drum. In such a developing device, toner leakage often becomes a problem. Due to the toner leakage, the inside of the developing device is smeared with toner, resulting in improper printing, or getting a user's hand or clothing dirty.

Above all, this tendency becomes high when a non-magnetic one-component agent is used as the toner. Because the toner is mainly held on the surface of the developing roller with the intermolecular force only, even a slightest impact or inclination causes the toner to leak from the periphery of the developing roller.

Generally, sealing members made of a urethane sponge or a PET film are affixed inside the developing device to prevent the toner leakage.

However, to form a high-precision image, a polymerized toner, whose particles are very small in diameter and have a spherical shape with high fluidity, has been generally used in recent years. Because of the high fluidity, the toner leaks from the sealing members.

In most cases, the toner that leaks in such manner is charged insufficiently or uncharged. Therefore, it is apt to be adhered to end portions of the photosensitive member which are out of an area for the image forming. As a result, the toner adheres to an end portion of the sheet, staining the sheet.

Further, the leaked toner soars into a mist and adheres to a wire of the charging device, having a detrimental influence on the discharge. The result is improper charging or the production of electric noise, and the operation of the image forming apparatus becomes unstable.

SUMMARY OF THE INVENTION

The invention overcomes the above-mentioned problems and provides an image forming apparatus that produces no deleterious effects on the image quality and the operation of the apparatus in the case of toner leakage.

Because toner migrates toward the ends of the photosensitive drum it is necessary to prevent material or contaminants that accumulate there from being freed so they migrate to the wire of the charging device. To preclude this, covers are provided that extend between the ends of the photosensitive drum and the ends of the wire to prevent free toner from reaching the wire. Further, scraping members are provided in the developing cartridge at each end of the photosensitive drum. The scraper members extend from compartments within the developing cartridge and catch toner that is scraped from the photosensitive drum.

BRIEF DESCRIPTION OF THE DRAWINGS

A preferred embodiment of the invention will be described in detail with reference to the following figures wherein.

DETAILED DESCRIPTION OF PREFERRED EMBODIMENTS

A preferred embodiment of the invention will be described in detail with reference to the accompanying drawings.

Figure 1:
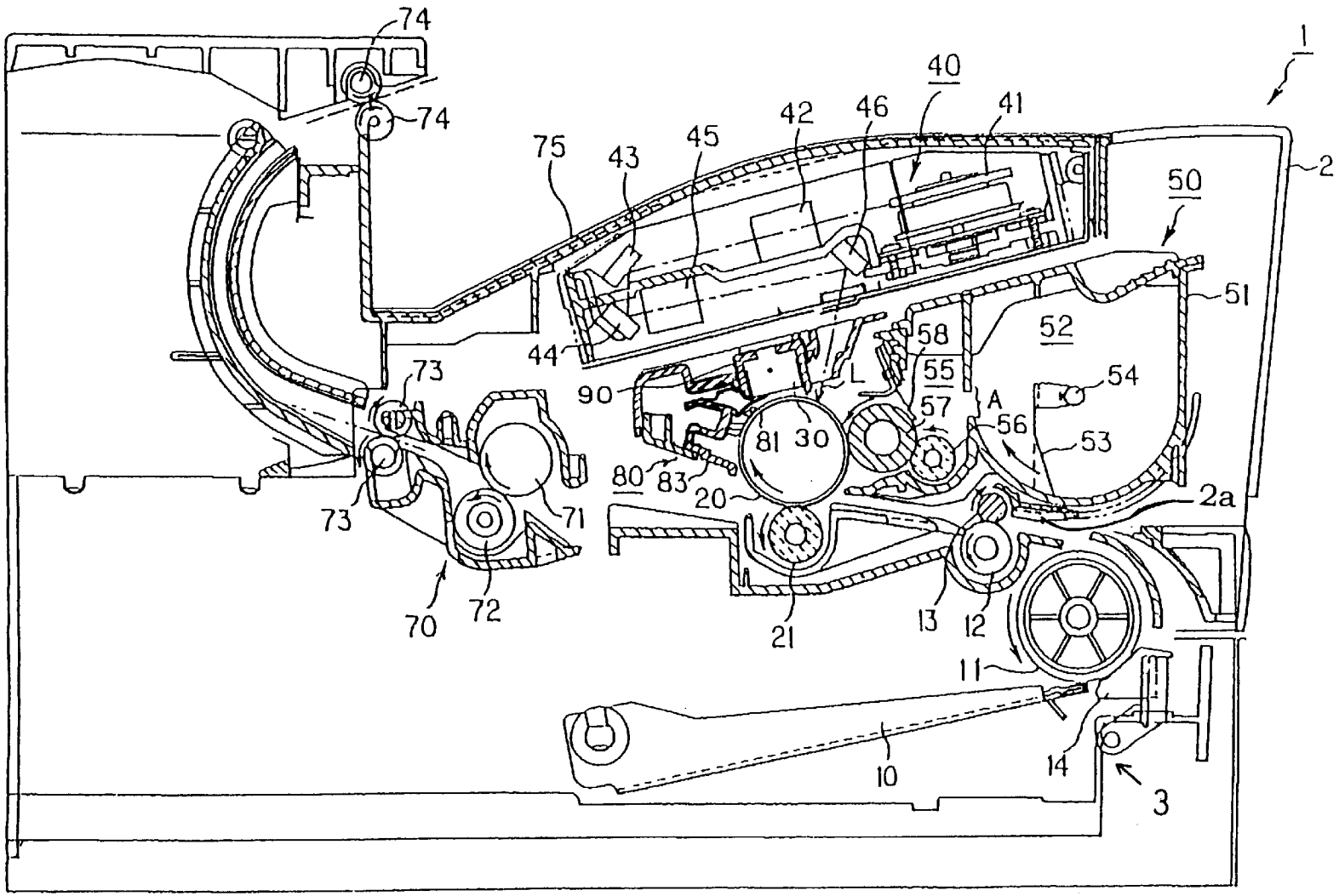
FIG. 1 is a sectional view schematically showing the structure of a laser beam printer.
Figure 2:
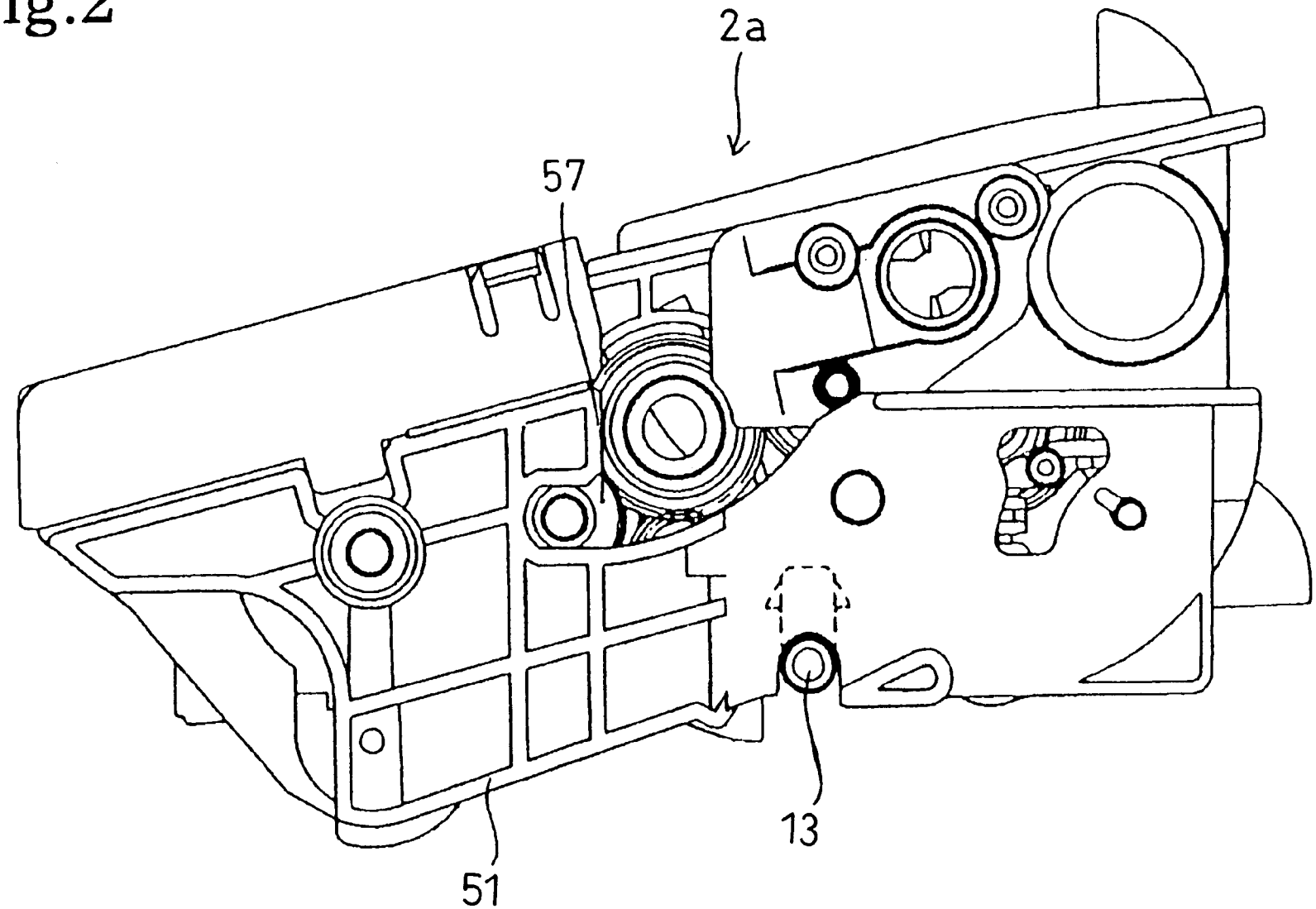
FIG. 2 is a side view of a process cartridge.

FIG. 1 is a sectional view schematically showing the structure of a laser beam printer 1. The laser beam printer 1 includes a feeder unit 3 for feeding paper on the bottom of a main case 2.

The feeder unit 3 comprises a paper pressing plate 10 that is urged upward by a spring (not shown), a paper feed roller 11, and a frictionally separating member 14 that is pressed against the paper feed roller 11. A sheet of paper stacked on the paper pressing plate 10 is pressed up so as to make contact with the paper feed roller 11. When the paper feed roller 11 is rotated in the direction of the arrow shown in FIG. 1 in a predetermined timed sequence, only the upper most sheet is separated and fed from between the paper feed roller 11 and the frictionally separating member 14.

A pair of resist rollers 12, 13 are rotatably supported downstream with respect to a paper feed path in which the paper is fed. The resist rollers 12, 13 convey the paper to a transfer position formed by a photosensitive drum 20 and a transfer roller 21 in the predetermined timed sequence.

The photosensitive drum 20 includes an organic photosensitive member mainly composed of polycarbonate which is to be positively charged. Specifically, the photosensitive drum 20 is formed of a cylindrical aluminum sleeve as a main body and a hollow drum on the outer circumference thereof. On the hollow drum, a light conductive layer with a thickness of approximately 20 $\mu$m is formed from resindispersed polycarbonate. The photosensitive drum 20 is rotatably supported on the main case 2 with the cylindrical sleeve being grounded, and rotationally driven by a driving mechanism (not shown) in the direction of the arrow.

Figure 3:
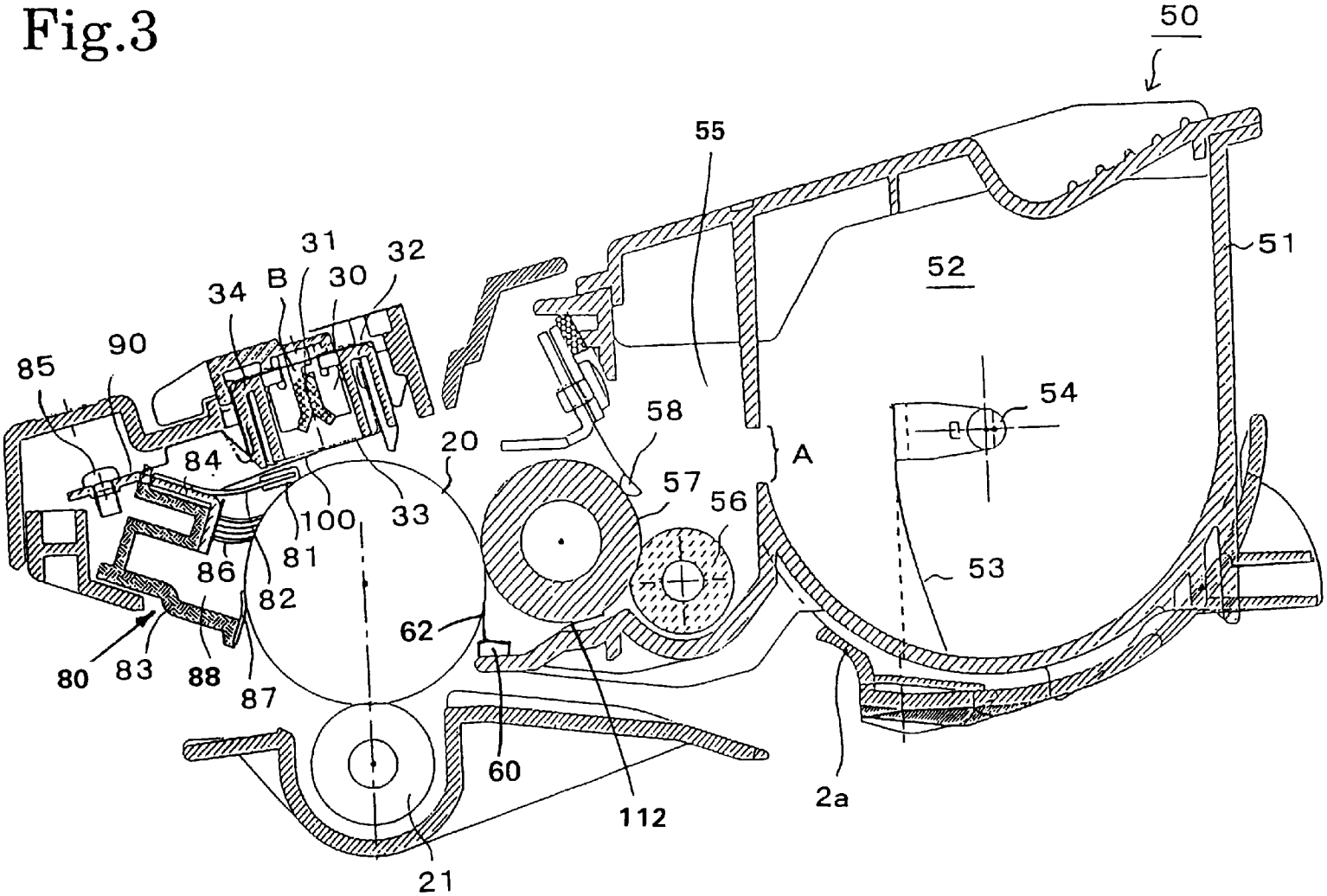
FIG. 3 is a sectional view of the developing device.

A charging device 30 is of the scorotron type and discharges a corona from a tungsten wire. As shown in FIG. 3, the charging device 30 includes a wire 31, a shield 32 surrounding the wire 31, and a grid electrode 33 provided so as to face the wire 31. The shield 32 is integral with the grid electrode 33. A holding portion 34 that holds the shield 32 is provided with an opening B. A charge-capturing electrode 90 is provided on the shield 32 so that it covers the opening B. One end of the charge-capturing electrode 90 extends toward a paper dust eliminator 80. The charge-capturing electrode 90 directly receives ions discharged from the wire 31, and becomes charged.

A laser scanner unit 40 includes a laser generator (not shown) that generates a laser beam L for forming an electrostatic latent image on the photosensitive drum 20, a polygon mirror (pentahedral mirror) 41 that is rotationally driven, a pair of lenses 42, 45, and reflection mirrors 43, 44, 46.

A toner chamber 52 is formed within a case 51 of the developing device 50. The toner chamber 52 accommodates an agitator 53, which is universally pivotable around a rotating shaft 54. The toner collected in the toner chamber 52 is a nonmagnetic, one-component developing agent that is to be positively charged. Each particle of the toner has a toner base particle of 6–10 $\mu$m in diameter and 8 $\mu$m on the average. The toner base particle is formed by adding a known coloring agent, such as carbon black, and a charge control agent, such as nigrosine, triphenylmethane, quanterary ammonium salt, to a styrene acrylic resin that is spherically formed by suspension polymerization. Silica, as an additive, is further added to the surface of the toner base particle.

Formed on the side of the photosensitive drum 20 is a developing chamber 55 in which a developing process is made through an opening A in the toner chamber 52. In the developing chamber 55, a toner supply roller 56 and a developing roller 57 are rotatably supported. The toner supply roller 56 supplies the toner, which is conveyed to the developing chamber 55 through the opening A, to the developing roller 57. The developing roller 57 carries the toner on a surface thereof. The toner on the developing roller 57 is regulated to a predetermined thickness by a layer thickness-regulating blade 58, which is an elastically thin metal sheet with a contact portion made of silicone rubber at a tip thereof.

The transfer roller 21 is rotatably supported and made from an electrically conductive foamed elastic material, such as a silicone rubber and a urethane rubber. When a voltage is applied to the transfer roller 21, a toner image on the photosensitive drum 20 is surely transferred onto the paper.

A process cartridge 2*a* includes the photosensitive drum 20, the charging device 30, the developing device 50, and the transfer roller 21 within a frame thereof. The process cartridge 2*a* is provided detachably to the laser printer 1. The developing device 50 is designed as a developing cartridge detachable from the process cartridge 2*a*.

The fixing unit 70 is provided further downstream with respect to the paper feed path where the paper is fed and passed between the resist rollers 12, 13 and between the photosensitive drum 20 and the transfer roller 21. The fixing unit 70 includes a heat roller 71 and a pressing roller 72. The toner image transferred onto the paper is heated and pressed while it is conveyed between the heat roller 71 and the pressing roller 72, and then the toner image is fixed on the paper.

A pair of conveying rollers 73 are provided downstream from the fixing unit 70 in the paper feed path. A pair of paper discharge rollers 74 and a discharged paper tray 75 are provided further downstream from the conveying rollers 73.

The paper dust eliminator 80 provided adjacent to the photosensitive drum 20 comprises a holder 83, a urethane sheet 82 supported to an upper portion of the holder 83 at a base end thereof and covered with the nonwoven cloth 81 at an edge thereof, a brush-like member 86 catching paper dust, and a conductive plate 84 supporting the brush-like member 86 and being mounted on the holder 83.

The adopted nonwoven cloth 81 is produced from a random arrangement of fibers intertwined with each other. This is because the cloth has highly flexible fibers and preferably catches minute pieces of paper dust among the fibers. Polyester or polyamide material is used. The nonwoven cloth 81 is impregnated with textile oil. As the textile oil, mineral oil or synthetic oil is used. The nonwoven cloth 81 is formed so that its longitudinal length is substantially equal to that of the photosensitive drum 20. A double-sided tape is affixed to the edge of the urethane sheet 82 as a base material in the sheet form.

The urethane sheet 82 is made of a urethane rubber and its harness is 92 degHs (JIS K-6301). The urethane sheet 82 is positioned so that its edge is pressed into contact with the photosensitive drum 20.

The holder 83 is formed so as to have the same length as the photosensitive drum 20 in the longitudinal direction. Both ends of the holder 83 in the longitudinal direction are secured to a frame supporting the photosensitive drum 20 using screws (not shown). A paper dust chamber 88 is formed inside the holder 83. It has an opening opposite the photosensitive drum 20. A urethane film 87 is attached to a lower portion of the holder 83 at its base end using the double-sided tape, and makes contact with the photosensitive drum 20 at its free end. The urethane film 87 helps to prevent paper dust from falling out of the chamber 88 in the holder 83.

The brush-like member 86 is a sheet on which fibers are transplanted. As shown in FIG. 3, it is provided on the conductive plate 84 made of aluminum. The plate 84 is mounted on the holder 83, and the urethane sheet 82 is affixed to the plate 84.

The plate 84 and the charge capturing electrode 90 are secured using a screw 85 at their ends. The charge-capturing electrode 90, the plate 84, and the brush-like member 86 are continuously electrically charged. As the charge capturing electrode 90 becomes charged by directly receiving ions discharged from the wire 31, the plate 84 and the brush-like member 86, which are electrically continuous with the charge capturing electrode 90, also become charged. In other words, voltages can be applied to the brush-like member 86 without the need for a power source only for it.

Figure 4:
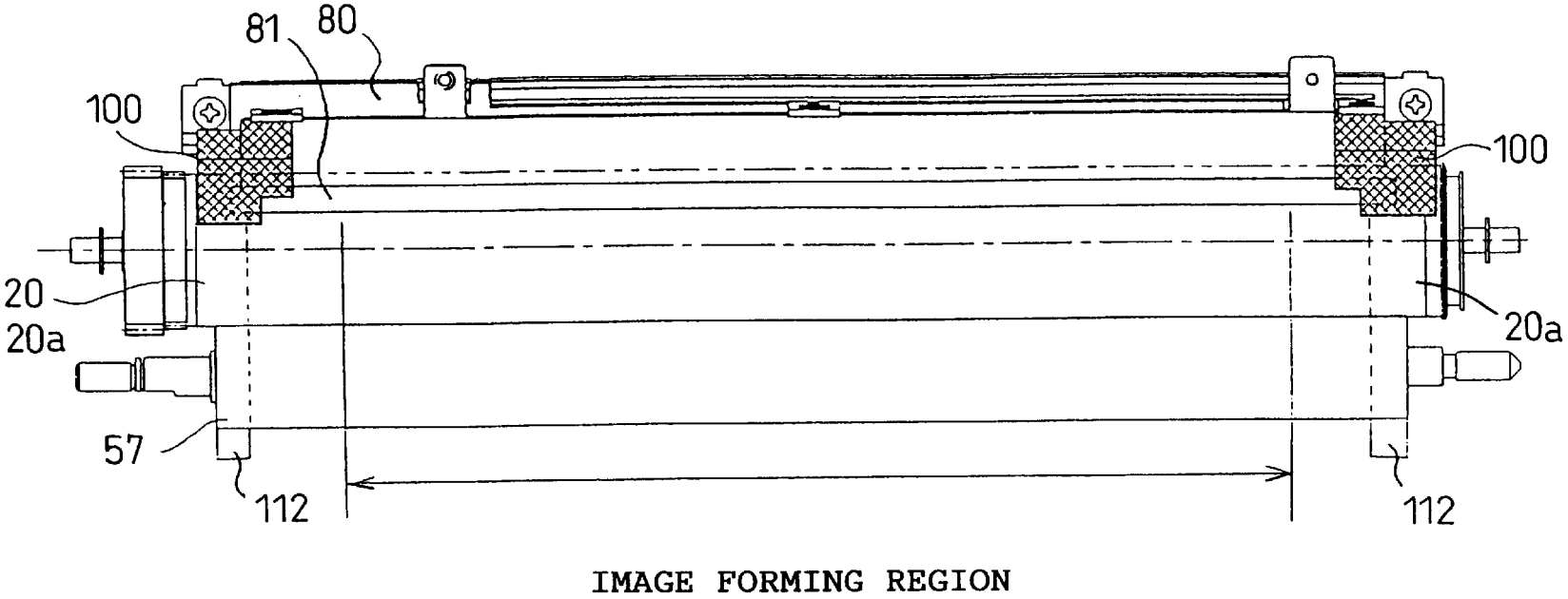
FIG. 4 is a plan view of the photosensitive device and paper dust eliminator.

As shown in FIG. 3, grid covers 100 are provided as partitioning members on an upper position of the paper dust eliminator 80. The grid covers 100 are made of an insulating resin member, such as PET. They are formed in such a size that they cover the nonwoven cloth 81 as shown in FIG. 4 and a part of the grid electrode 33, as shown in FIG. 3, at both ends of the photosensitive drum 20. However, the positions of the grid covers 100 are adjusted so that they do not cover the wire 31 at their edges on the side of the grid electrode 33. Therefore, the grid covers 100 have no detrimental effect on the charging process of the photosensitive drum 20 by the charging device 30.

Figure 5A:
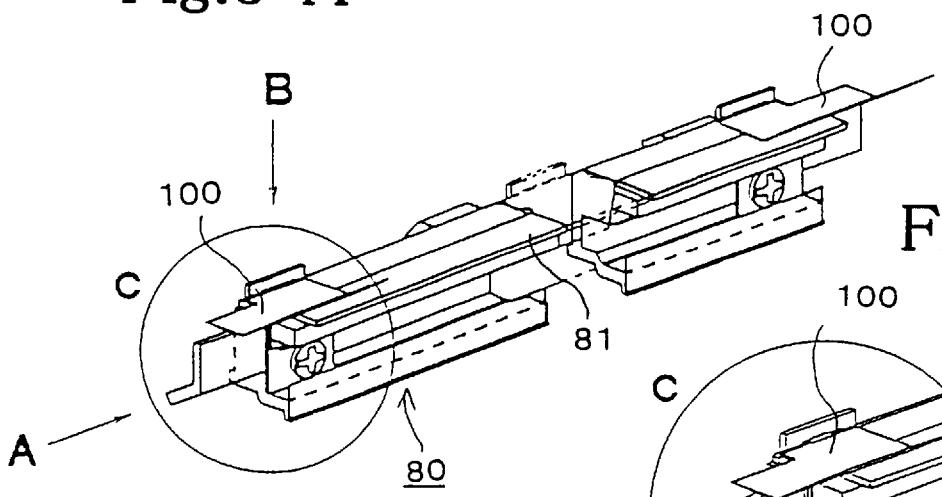
FIG. 5A is a perspective view showing grid covers and a paper dust eliminator.
Figure 5B:
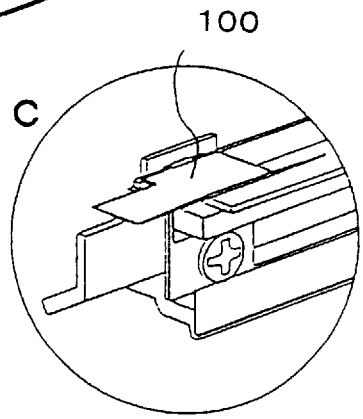
FIG. 5B is an enlarged view of a part C circled in FIG. 5A.
Figure 5C:
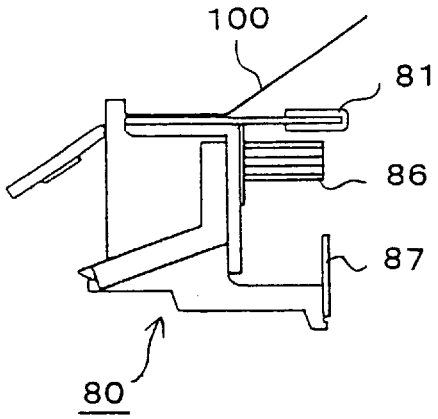
FIG. 5C is a side elevation of the grid cover and the paper dust eliminator when viewed from the direction A of FIG. 5A.
Figure 5D:
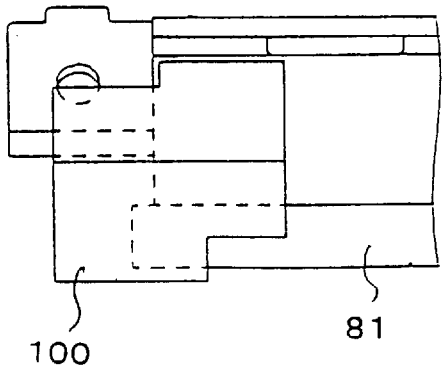
FIG. 5D is an enlarged plan view showing how the grid cover is attached.

The grid covers 100 are affixed to the urethane sheet 82 to which the nonwoven cloth 81 is attached by using an adhesive or double-sided tape, as shown in FIGS. 5A to 5D. FIG. 5A is a perspective view showing the grid covers 100 and the paper dust eliminator 80. FIG. 5B is an enlarged view of a part C circled in FIG. 5A. FIG. 5C is a side elevation of the grid cover 100 and the paper dust eliminator 80 when viewed from the direction A of FIG. 5A. FIG. 5D is an enlarged plan view showing how the gird cover is attached.

The grid covers 100 are bent with a predetermined angle to an affixing portion as shown in FIGS. 5A to 5D. As shown in FIG. 3, they are structured so as to press into contact with the grid electrode 33. They are also structured so that a predetermined clearance is formed between each of the grid covers 100 and the nonwoven cloth 81 when the paper dust eliminator 80 is mounted to the process cartridge 2*a*. Accordingly, no detrimental effect is given to the contact status of the nonwoven cloth 81 on the photosensitive drum 20.

In addition, the grid covers 100 are provided at positions corresponding to both ends 20*a* of the photosensitive drum 20 which are out of the image forming area, as shown in FIG. 4. Sealing members 112 are pressed into contact with the developing roller 57 at both ends, also out of the image forming area, to prevent the toner leakage.

Figure 8:
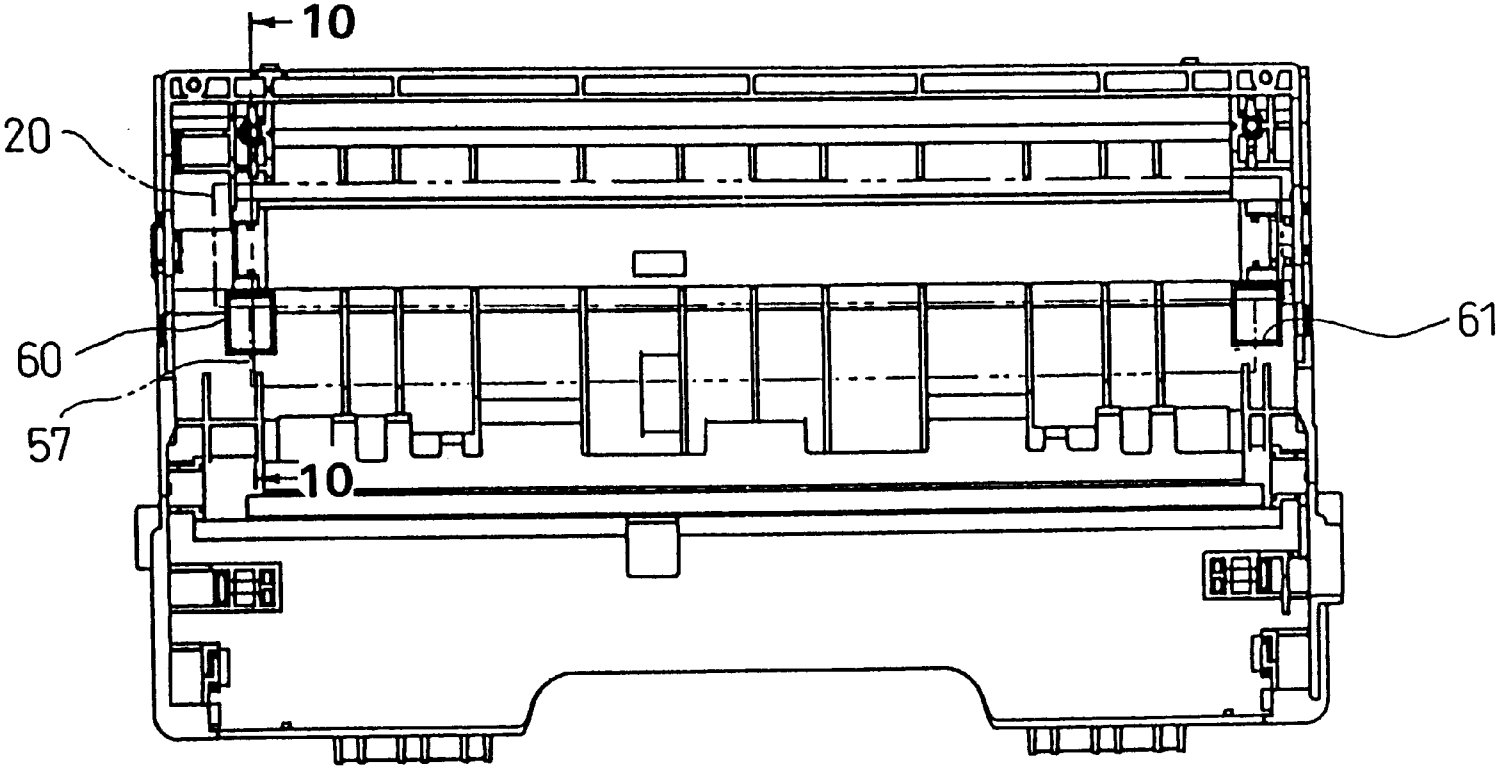
FIG. 8 is a plan view showing the process cartridge when the developing device is removed therefrom.

FIG. 8 is a plan view showing the process cartridge 2*a* when the developing device 50 is removed therefrom. The photosensitive drum 20 is indicated by a double dashed chain line.

Figure 9A:
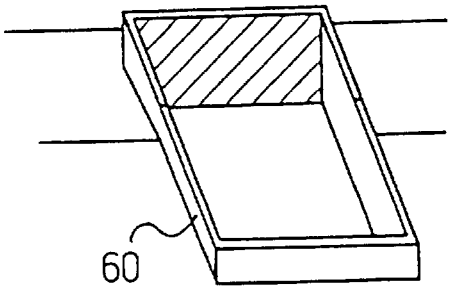
FIGS. 9A and 9B are perspective views of toner chambers of the process cartridge.
Figure 9B:
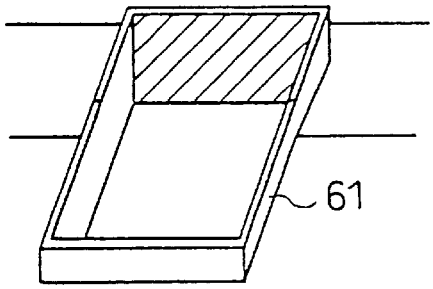

As shown in FIG. 8, toner chambers 60, 61 are formed at places corresponding to both ends of the photosensitive drum 20. The toner chambers 60, 61 are a quadrangle surrounded by walls on all sides as shown in FIGS. 9A and 9B. They are formed integrally with the process cartridge 2*a*.

Figure 9C:
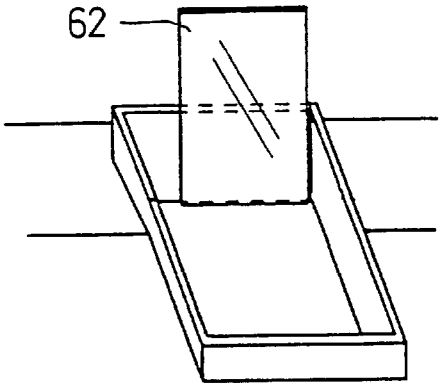
FIG. 9C and 9D show drum wipers fixed to the toner chambers.
Figure 9D:
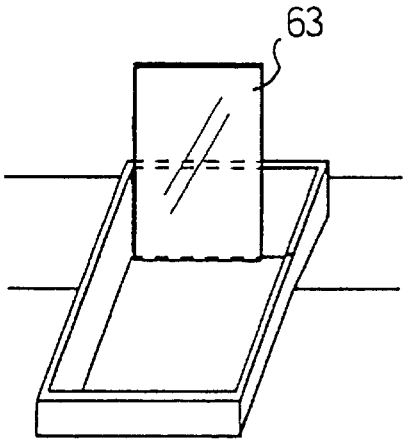

Drum wipers 62, 63 of FIGS. 9C and 9D are affixed to the shaded areas of the toner chambers 60, 61 of FIGS. 9A and 9B respectively by double-sided tape.

The drum wipers 62, 63 are made of the PET film, however, they can be made of a resin film such as a urethane film.

Figure 10A:
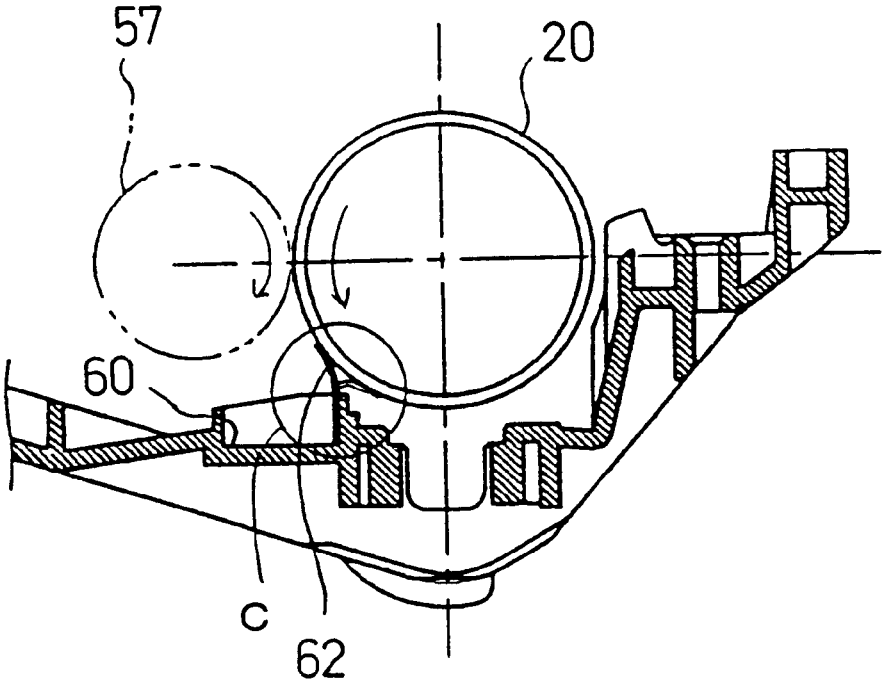
FIG. 10A is a sectional view of the process cartridge with the photosensitive drum mounted, taken along the plane of line 10—10 of FIG. 8.

When the drum wipers 62, 63 are affixed to the toner chambers 60, 61, and the photosensitive drum 20 is mounted on the process cartridge 2*a*, the drum wipers 62, 63 are pressed into contact with the peripheral surfaces the photosensitive drum 20 at both ends, as shown in FIG. 10A. FIG. 10A is a sectional view of the process cartridge 2*a* with the photosensitive drum 20 mounted, taken along the plane of line 10—10 of FIG. 8.

Figure 10B:
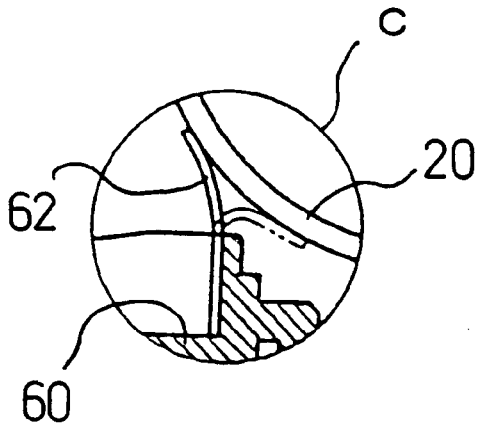
FIG. 10B is an enlarged view of a part C circled in FIG. 10A.

When the photosensitive drum 20 is mounted, as shown in FIG. 10B, the drum wiper 62 makes contact with the photosensitive drum 20 in directions opposite to one another. This is because the toner can not be effectively removed if the drum wiper 62 makes contact with the photosensitive drum 20 only in the same direction, as indicated with a double dashed chain line.

The drum wipers 62, 63 are provided at both ends of the photosensitive drum 20, out of the image forming area, and which also correspond to both ends of the developing roller 57. The places at which the drum wipers 62, 63 are provided are chosen based on a determination the toner leakage is apt to occur from both ends of the developing roller 57 of the developing device 50 and the toner transferred onto the photosensitive drum 20 is easily collected on both ends of the photosensitive drum 20.

The operation of the laser beam printer I will now be described.

First, the surface of the photosensitive drum 20 is charged uniformly by the charging device 30. When it is irradiated by the laser beam L, that is modulated according to image information from the scanner unit 40, an electrostatic latent image corresponding to the image information is formed on the surface of the photosensitive drum 20. The toner is adhered onto the electrostatic latent image in the developing device 50, making the electrostatic latent image visible. The visible image formed on the surface of the photosensitive drum 20 is conveyed to the transfer position along with the rotation of the photosensitive drum 20. At the transfer position, the paper is supplied via the paper feed roller 11 and the resist rollers 12, 13. The transfer bias applied by the transfer roller 21 allows the visible image on the surface of the photosensitive drum 20 to be transferred onto the paper.

The paper onto which the visible image has been transferred is conveyed to the fixing unit 70. The paper is sandwiched between the heat roller 71 and the pressing roller 72 to pass through therebetween, and the visible image is fixed onto the paper by the pressure and the heat. The paper onto which the visible image has been fixed is ejected to the paper tray 75 on the upper position of the laser beam printer 1 via the conveying rollers 73 and the paper discharge rollers 74, and this completes the image formation.

The toner remaining on the surface of the photosensitive drum 20 after the transfer is collected to the developing device 50, and reused for the developing. In this manner, the laser beam printer 1 adopts so-called cleaner-less developing method. Therefore, no container for waste toner scraped from the surface of the photosensitive drum 20 is needed. This enables a reducation in the size of the laser beam printer 1 and for the effective use of the toner.

The paper dust is accumulated on the photosensitive drum 20 after the transfer. However, big fibrous paper dust is caught by the brush-like member 86, and minute dust is eliminated by the nonwoven cloth 81.

Above all, applied to the brush-like member 86 is the voltage delivered by the charge capturing electrode 90 that becomes charged by a discharge from the wire 31 of the charging device 30. As a result, the paper dust removing performance is extremely high. The paper dust becomes charged in a polarity opposite to that of the toner by the bias whose polarity is opposite to the toner charged during the transfer. On the other hand, the polarity of the voltage applied to the charging device 30 is the same as that of the toner. Thus, the charge-capturing electrode 90 and the brush-like member 86 have the same polarity as the toner, enabling the collection of the paper dust.

As described above, the laser beam printer 1 of the embodiment can apply the appropriate voltage to the brush-like member 86 without the need for a power source only for it. As a result, the manufacturing costs can be significantly reduced.

Figure 6:
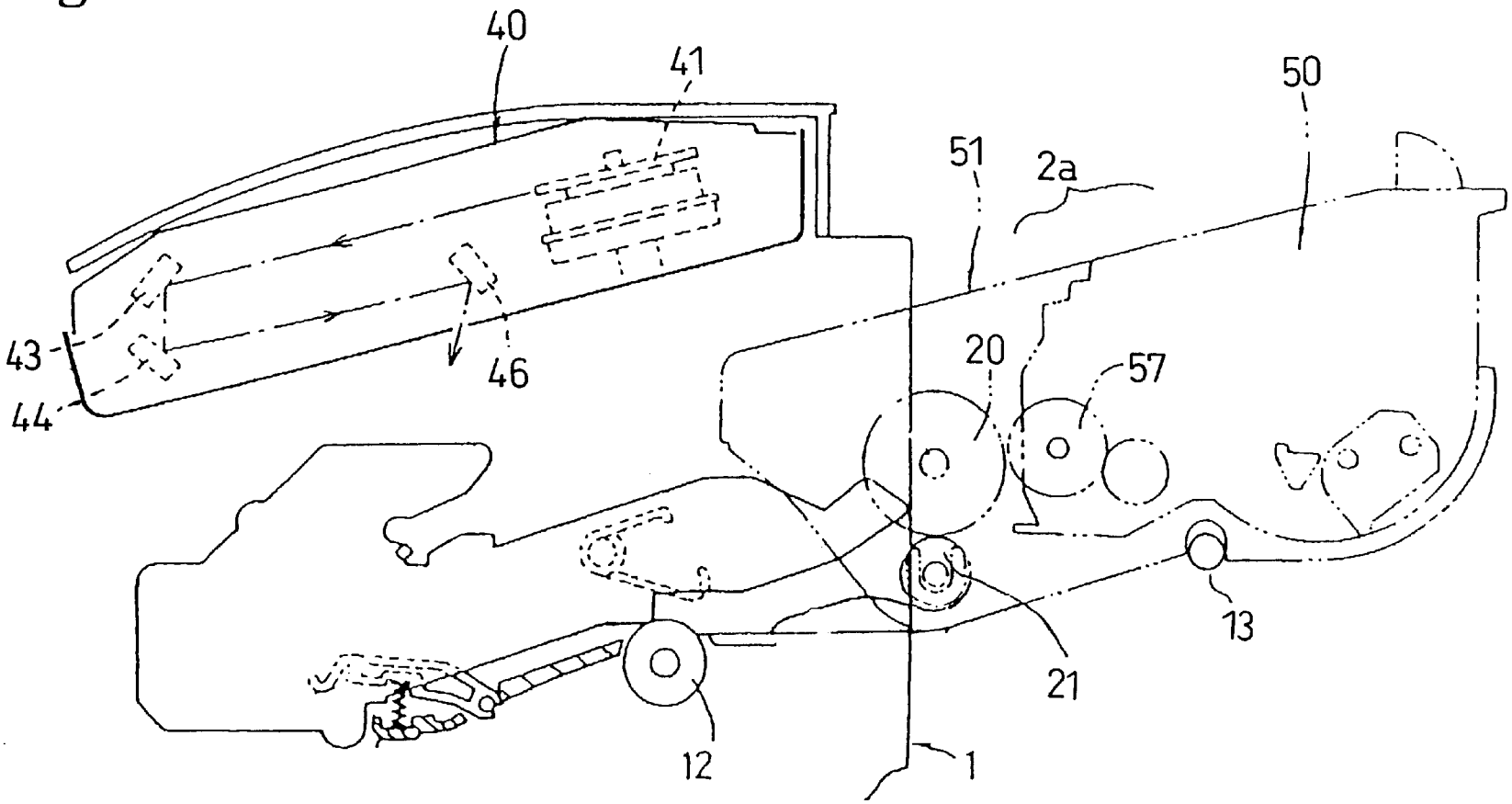
FIG. 6 shows removal of the process cartridge from the printer.
Figure 7:
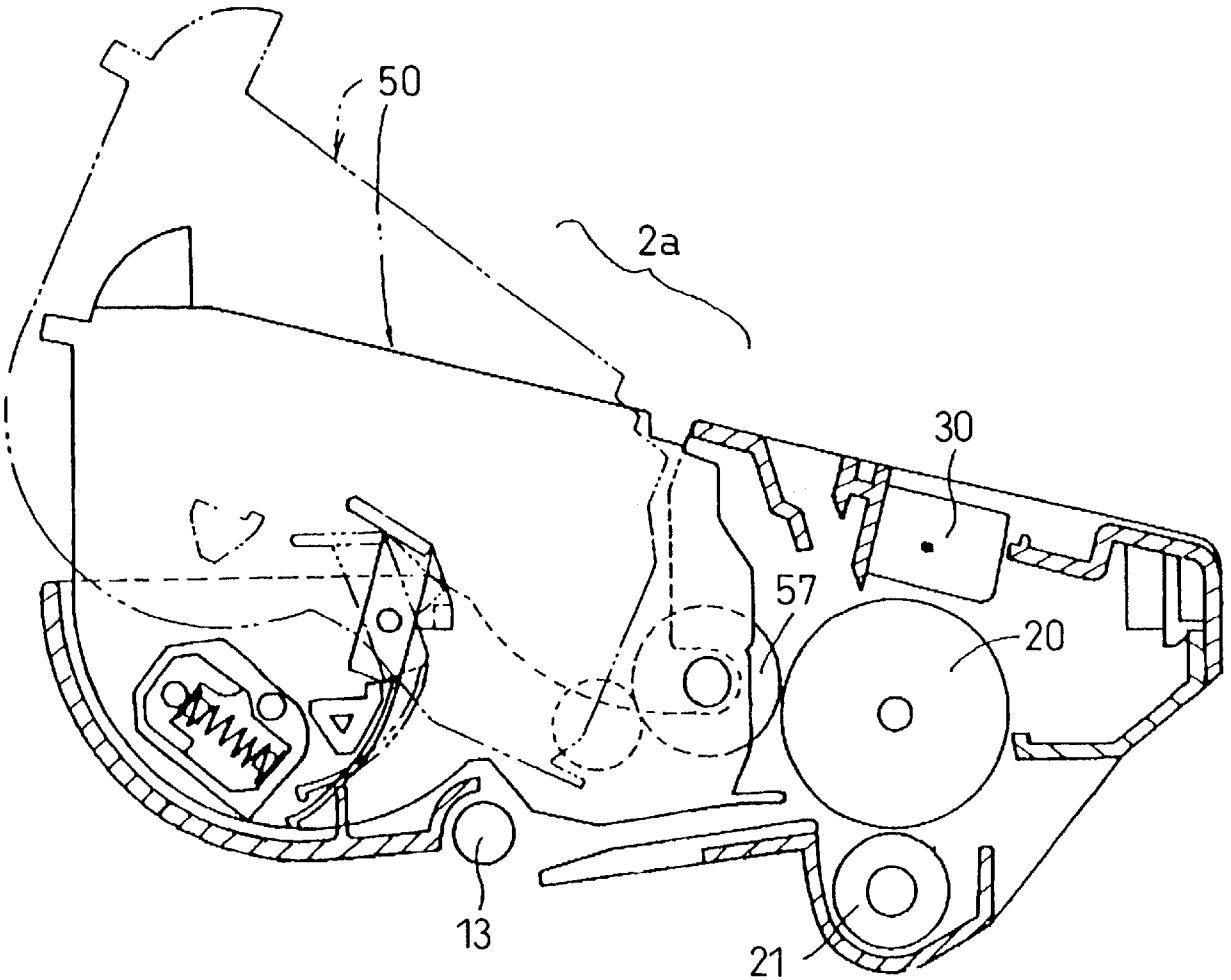
FIG. 7 shows removing the developing device from a processing cartridge.

As such a printing operation proceeds, the toner collected in the developing device 50 is consumed. In this case, the process cartridge 2*a* in use is taken out of the front of the laser beam printer 1, as shown in FIG. 6, and the developing device 50 is removed from the process cartridge 2*a*, as shown in FIG. 7. A new developing device 50 is placed in the process cartridge 2*a*, and then the process cartridge 2*a* is inserted from the front into the laser beam printer 1. Thus, anybody can supply the toner easily without getting his or her hands dirty. Further, if the photosensitive drum 20 deteriorates, similarly as with the above case, the process cartridge 2*a* is taken out, and a new process cartridge 2*a* is installed in the laser beam printer 1.

However, if a non-experienced user installs the developing device 50 as described above, oscillation and impact are given to the developing device 50, and the toner leaks from the sealing members 112 on both ends of the developing roller 57. Consequently, the toner undesirably remains adhered in lines, such as indicated by the dotted lines of FIG. 4. Because the toner is not given a sufficient or normal frictional electric charge, it is transferred onto the ends 20*a* of the photosensitive drum 20 which are out of image forming area.

As described above, the drum wipers 62, 63 are positioned between a developing area where the developing roller 57 and the photosensitive drum 20 face each other and a transfer area where the photosensitive drum 20 and the transfer roller 21 face each other. If the toner should leak from the developing device 50 and transfer to the photosensitive drum 20, the transferred toner is wiped off by the drum wipers 62, 63, and dropped to the toner chambers 60, 61 before it is transferred onto the paper. Thus, in the transfer area, the toner that is not charged or insufficiently charged does not adhere to the ends 20*a* of the photosensitive drum 20 which are out of the image forming area, and a clean transfer is made.

As above, even if the toner leaks from the developing device 50, the toner on the photosensitive drum 20 can be wiped off by the drum wipers 62, 63. Therefore, smudges on a side of the paper are prevented.

The toner that the drum wipers 62, 63 can not wipe off or the toner that adheres out of the range of the drum wipers 62, 63 remains on the ends 20*a* of the photosensitive drum 20 and accumulates at the contact portion between the non-woven cloth 81 and the photosensitive drum 20, or passes through the contact portion.

The toner accumulating or passing through the contact portion as above spatters from the contact portion to the outside.

However, the contact portion is covered with the grid covers 100, and a part of the grid electrode 33 is also covered with the grid covers 100. If the toner spatters, it does not enter the inside of the charging device 30 or adhere to the wire 31. As a result, abnormal discharge caused by the toner does not occur in the charging device 30, and improper printing and noise occurrence are prevented.

Figure 11:
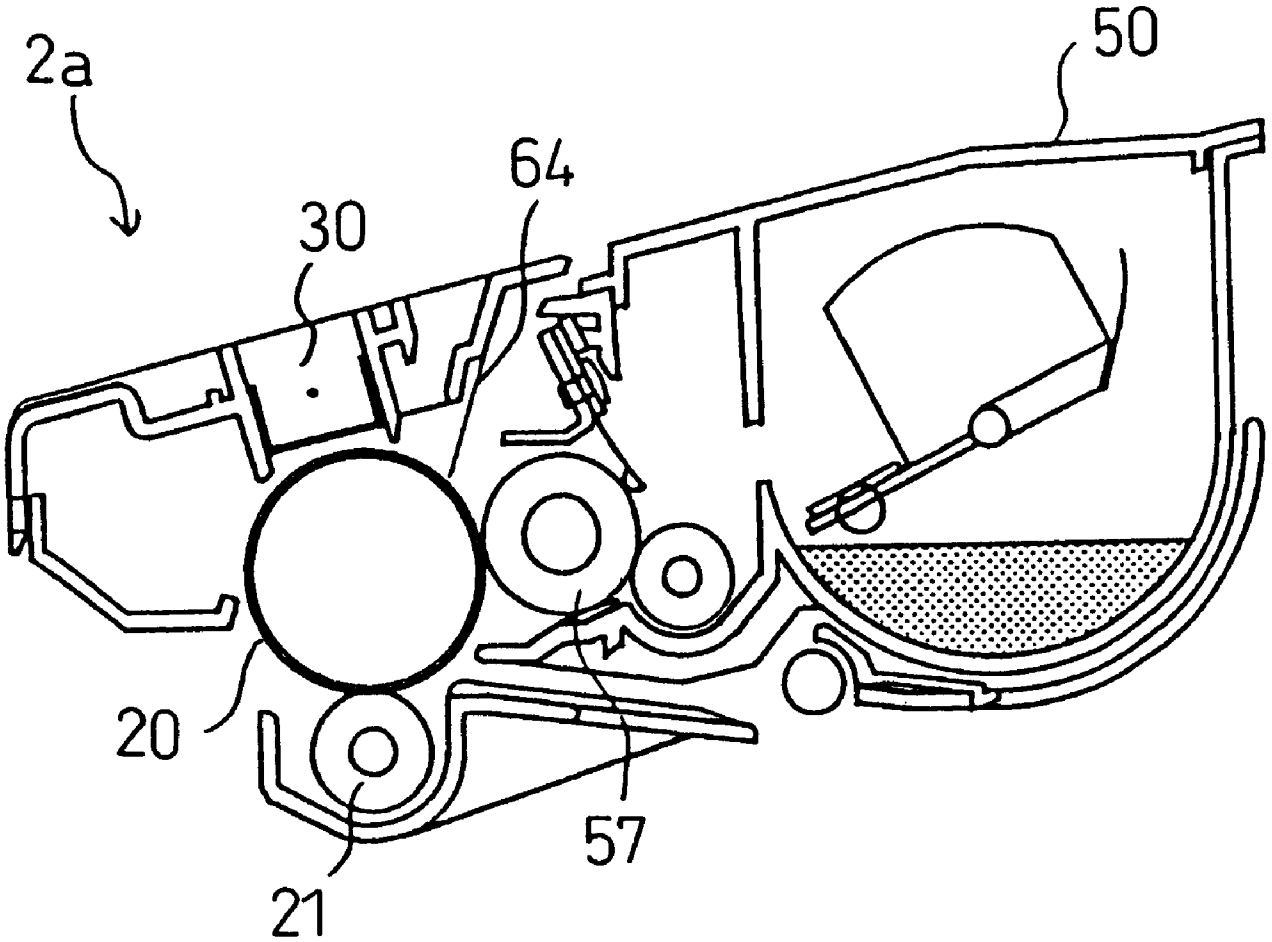
FIG. 11 shows a sectional side view of the process cartridge and a partition member therein.

Furthermore, a partition film 64 formed extending in the longitudinal direction of the photosensitive drum 20 can be disposed between the developing device 50 and the charging device 30 as shown in FIG. 11.

The partition film 64 is made of the PET. When the partition film 64 is provided, in the unlikely event that the toner leaks from the developing device 50, the toner is stopped at the partition film 64, and does not reach the charging device 30. Therefore, it does not adhere to the wire 31.

As a result, improper charging by the charging device 30 does not occur, and electrical noise is not produced., Accordingly, the operation of the laser beam printer 1 becomes stable.

As an electrode causing a corona discharge in the charging device 30, the wire electrode is adopted. However, an acicular electrode or a saw-tooth electrode can be adopted.

The invention can be applied to the charging of not only the photosensitive drum 20 but also an intermediate transfer member or paper in a color image forming apparatus.

The grid covers 100 made of the PET sheets are affixed, but they can be formed so that they are integral with the frame of the process cartridge 2*a*.

The invention is not restrictive to details of the illustrated embodiment, but may be otherwise embodied with various changes or modifications in control of each portion of the apparatus, without departing from the principle of the invention.

What is claimed is:

1. A cartridge, comprising:

a photosensitive member including an image forming area;

a charging wire to charge the photosensitive member;

a grid electrode provided over the charging wire; and a grid cover provided adjacent each end of the photosensitive member which is out of the image forming area, each grid cover being over a corresponding end of the grid electrode and not over a corresponding end of the charging wire.

2. The cartridge according to claim 1, further comprising:

a support accommodating the photosensitive member; and a film extending from the support at each end of the photosensitive member.

3. The cartridge according to claim 2, wherein the support has a chamber at each end of the photosensitive member, the film extending from the chamber to contact the photosensitive member, the chamber storing toner scraped from the photosensitive member by the film.

4. The cartridge according to claim 1, further comprising a paper dust removing device comprising:

a holder extending parallel to the photosensitive member;

a urethane film extending from a bottom edge of the holder and contacting the photosensitive member, the urethane film and the holder defining a paper dust chamber;

a brush like member mounted to the holder above the urethane film and extending along the photosensitive member; and a sheet member mounted to a top of the holder and extending along and contacting the photosensitive member.

5. The cartridge according to claim 4, further comprising a non-woven cloth attached to the sheet member at an edge contacting the photosensitive member.

6. The cartridge according to claim 5, wherein the non-woven cloth is impregnated with a textile oil.

7. The cartridge according to claim 5, wherein the grid cover is mounted to the sheet member at each end of the photosensitive member, each grid cover extending over but separated from the non-woven cloth.

8. The cartridge according to claim 4, further comprising:

a conductive plate mounted to the top of the holder between the holder and the sheet member and having a substantially L-shaped cross-section; and a charge capturing electrode attached to the conductive plate at one end and extending across the charging wire at an opposite end, wherein the brush is attached to a leg of the conductive plate.

9. The cartridge according to claim 1, further comprising:

a support accommodating the photosensitive member;

a pair of toner chambers formed in the support, each toner chamber being formed to oppose a corresponding end of the photosensitive member; and a wiper mounted in each toner chamber and contacting an end of the photosensitive member.

10. The cartridge according to claim 9, further comprising:

a holder extending parallel to the photosensitive member;

a conductive plate mounted to the top of the holder and having a substantially L-shaped cross-section;

a charge capturing electrode attached to the conductive plate at one end and extending across the charging wire at an opposite end;

a urethane film extending from a bottom edge of the holder and contacting the photosensitive member, the urethane film and the holder defining a paper dust chamber;

a brush like member mounted to the holder above the urethane film and extending along the photosensitive member; and a sheet member mounted to a top of the holder and extending along and contacting the photosensitive member.

11. The device according to claim 10, further comprising a non-woven cloth attached to the sheet member at an edge contacting the photosensitive member.

12. The device according to claim 11, wherein the non-woven cloth is impregnated with a textile oil.

13. The device according to claim 11, wherein each grid cover is mounted to the sheet member and extends over but is separated from the non-woven cloth.

14. A contamination reducing device for use with an electrostatic printer having a removable processing cartridge mounting a detachable developing cartridge, the contamination reducing device comprising:

a holder extending parallel to a photosensitive member of the printer;

a conductive plate mounted to the top of the holder and having a substantially L-shaped cross-section;

a charge capturing electrode attached to the conductive plate at one end and extending across a charging device of the electrostatic printer at an opposite end;

a urethane film extending from a bottom edge of the holder and contacting the photosensitive member, the urethane film and the holder defining a paper dust chamber;

a brush like member mounted to a leg of the conductive plate above the urethane film and extending along the photosensitive member;

a sheet member mounted to the conductive plate and extending along and contacting the photosensitive member;

a non-woven cloth attached to the sheet member at an edge contacting the photosensitive member; and a pair of grid covers mounted to the sheet member at each end of the photosensitive member, each grid cover extending over but separated from the non-woven cloth.

15. The device according to claim 14, further comprising:

a pair of toner chambers formed in the processing cartridge mounted in the electrostatic printer, a toner chamber formed to oppose each end of the photosensitive member; and a wiper mounted in each toner chamber and contacting an end of the photosensitive member.

16. The device according to claim 14, further comprising a partition film extending between a casing of a developing device mounted in the processing cartridge to proximate the photosensitive member, the partition film separating the charging device from a toner provided portion of the electrostatic printer.

17. A cartridge, comprising:

a photosensitive member;

a charging device for charging a surface of the photosensitive member, the charging device including a charging wire and a grid electrode provided over the charging wire;

a paper dust removing device that contacts the surface of the photosensitive member, the paper dust removing device being disposed upstream of the charging device; and a grid cover provided adjacent a corresponding end of the photosensitive member, each grid cover being over a corresponding end of the grid electrode and not over a corresponding end of the charging wire.

18. The cartridge according to claim 17, further comprising:

a support accommodating the photosensitive member, the support including a chamber at each end of the photosensitive member; and a film extending from each chamber to contact the photosensitive member, each chamber storing toner scraped from the surface of the photosensitive member by the film.

19. The cartridge according to claim 17, wherein the paper dust removing device comprises:

a holder extending parallel to the photosensitive member;

a urethane film extending from a bottom edge of the holder and contacting the photosensitive member, the urethane film and the holder defining a paper dust chamber;

a brush like member mounted to the holder above the urethane film and extending along the photosensitive member; and a sheet member mounted to a top of the holder and extending along and contacting the photosensitive member.

20. The cartridge according to claim 19, further comprising a non-woven cloth attached to the sheet member at an edge contacting the photosensitive member.

21. The cartridge according to claim 20, wherein the non-woven cloth is impregnated with a textile oil.

22. The cartridge according to claim 20, wherein the cover is mounted to the sheet member at each end of the photosensitive member, each grid cover extending over, but separated from the non-woven cloth.

* * * * *